United States Patent [19]

Sahni

[11] 4,047,538

[45] Sept. 13, 1977

[54] CHANGE DISPENSING APPARATUS

[75] Inventor: Ram N. Sahni, Ithaca, N.Y.

[73] Assignee: NCR Corporation, Dayton, Ohio

[21] Appl. No.: 638,728

[22] Filed: Dec. 8, 1975

[51] Int. Cl.[2] ..... G07D 1/00

[52] U.S. Cl. ..... 133/4 R; 221/266

[58] Field of Search ..... 133/2, 4 R, 4 A, 5 R, 133/6; 221/270, 273-276, 277, 266; 271/129

[56] References Cited

U.S. PATENT DOCUMENTS

| | | | |
|---|---|---|---|
| 542,329 | 7/1895 | Brandt | 133/4 R |
| 1,036,645 | 8/1912 | Kleinbaum | 133/4 A |
| 1,385,359 | 7/1921 | Bruhn et al. | 133/4 R |
| 2,250,351 | 7/1941 | Blake | 221/274 |
| 3,144,113 | 8/1964 | Peterson | 221/274 |
| 3,221,858 | 12/1965 | Mielke | 133/4 R |

*Primary Examiner*—Robert B. Reeves
*Assistant Examiner*—H. Grant Skaggs
*Attorney, Agent, or Firm*—J. T. Cavender; Wilbert Hawk, Jr.; Richard W. Lavin

[57] ABSTRACT

There is disclosed a low cost change dispensing apparatus which includes a plurality of coin channels supported at an acute angle with a horizontal plane. Coins are stacked on edge in each of the coin channels. A coin delivery mechanism associated with each coin channel includes a rockable actuator member which supports the lowermost coin of each channel on a laterally extending supporting surface. The actuator member is selectively rocked by the energizing of a solenoid member to eject the lowermost coin into a coin chute which delivers the coin to a coin receptacle. Associated with each actuator member is a guide member positioned adjacent the coin supporting surface of the actuator member for locating the lowermost coin of each coin channel on the supporting surface when the actuator member is in the home or coin non-dispensing position.

18 Claims, 6 Drawing Figures

CHANGE DISPENSING APPARATUS

BACKGROUND OF THE INVENTION

Prior change dispensing apparatus of the type which are remotely operated by data terminal devices are generally of the construction in which a selecting mechanism associated with each coin supply channel is operated to select which coins are to be dispensed and further includes a motor driven actuator member which is operated to deliver the selected coins from the coin supply channels to a coin receptacle. Also, due to the fact that the coin supply channels of such prior dispensers are generally orientated in a vertical direction, the removal of the lowermost coin of each coin channel requires the dispensing mechanism to overcome the weight of the stacked coins resulting in complex dispensing mechanisms and large drive motors. As a result, the cost of construction of the change dispensing mechanism of the prior art becomes quite high. An example of this type of mechanism is to be found in U.S. Pat. No. 2,954,037 and assigned to the assignee of the present application. Other drawbacks inherent with this prior type of construction includes high cost of repairing the units and relatively slow speed of operation. It is, therefore, an object of this invention to provide a new and improved change dispensing mechanism which is simple in both operation and construction and therefore low in cost. Another object of this invention is to provide a change dispensing mechanism which utilizes gravity to feed coins into a dispensing position in the coin channel and to dispense coins from the coin channels to the coin receptacle. It is a further object of this invention to provide a new and improved change dispensing mechanism which requires a relatively low powered actuating mechanism to dispense coins from the coin channels. It is another object of this invention to provide a change dispensing apparatus having a construction which provides extremely easy loading of coins into the coin supply channels. It is a still further object of this invention to provide a change dispensing mechanism which provides for the easy removal of the coin magazine from the dispensing apparatus for changing the number and denomination of the coins to be dispensed.

SUMMARY OF THE INVENTION

In accordance with these objects of the invention, there is provided a change dispensing apparatus which includes a coin magazine insertably mounted within a housing and which includes a plurality of coin channels arranged at an acute angle with a horizontal plane. Mounted adjacent the discharge portion of each coin channel is a vertically extending guide member which stacks coins on their edges in the coin channel to allow the coins to be dispensed from the coin channels on their edges. Associated with each of the coin channels is a coin actuator which comprises a pivoted support member having a coin supporting surface for supporting the lowermost coin of the coin channel on its edge. The coin supporting surface in each instance includes an abutment portion which prevents the coin from rolling off the supporting surface when the support member is in the home position adjacent the coin channel. An electromagnetic drive member mounted adjacent the support member when energized will rock the support member to a position where the coin supported thereby will roll off the supporting surface into a coin chute from which the coin will be deposited in a coin tray.

The foregoing and other objects, features and advantages of the invention will become apparent from the following preferred embodiment illustrated in the accompanying drawings.

DESCRIPTION OF THE PREFERRED EMBODIMENT

Figure 1:
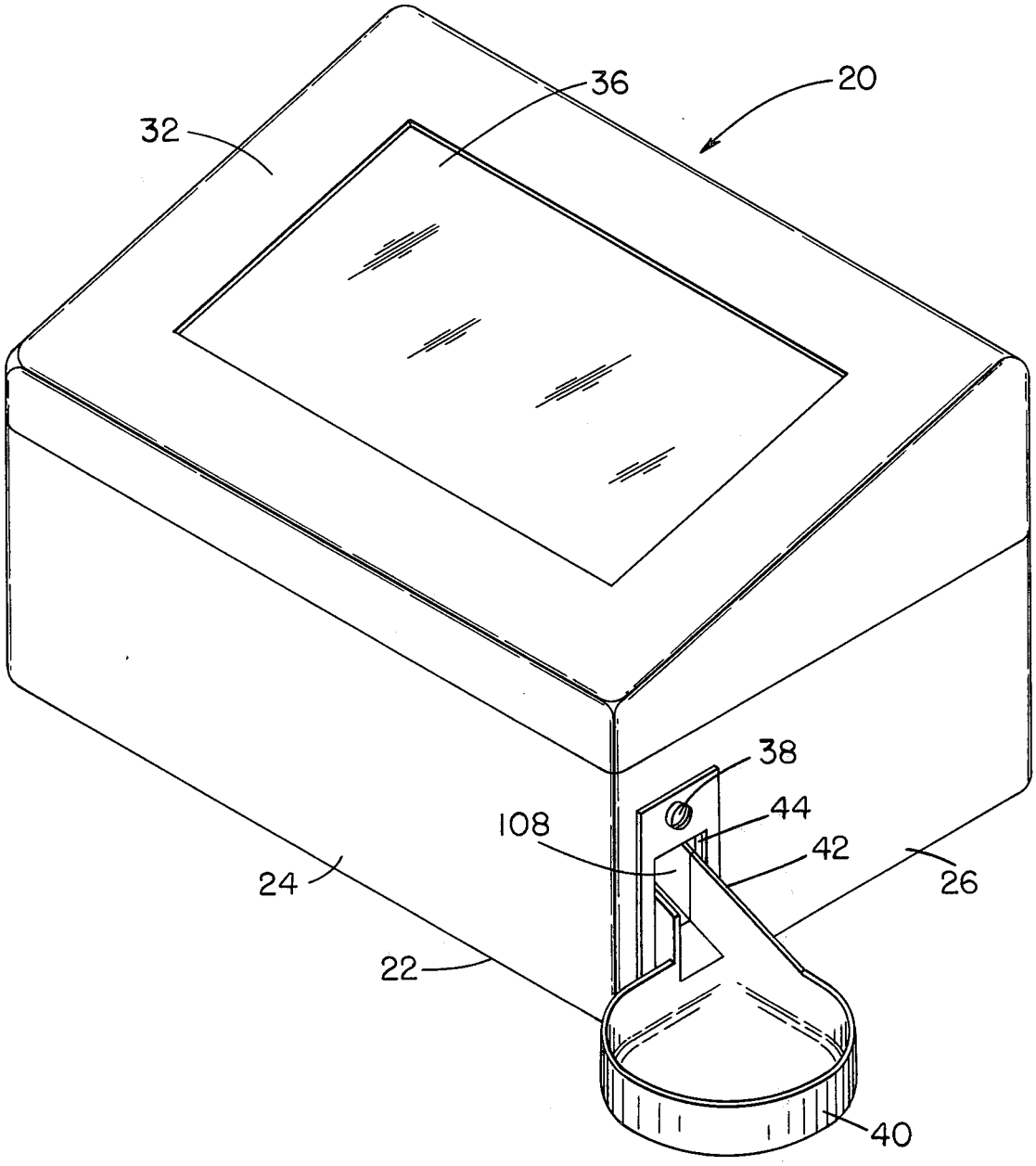
FIG. 1 is an oblique view of the change dispensing apparatus in accordance with the present invention showing the window portion of the cover through which the operator can determine the condition of the coin supply in the apparatus.

Referring now to the drawings and specifically to FIG. 1, there is shown a change dispensing apparatus constructed in accordance with the present invention and designated generally by the numeral 20. Such dispensing apparatus 20 (see also FIG. 2) includes a housing member 22 which is provided with a front wall 24, opposing side walls 26 and 27, a rear wall 28 and a base portion 30 (see also FIG. 3). A cover member 32 (FIG. 1) is rotatably mounted to the top of the rear wall 28 by any conventional connecting means such as hinges 34 (FIG. 4), the cover member 32 being provided with a window portion 36 to allow viewing of the coins within the housing 22. Affixed to the outside of the side wall 26 of the dispensing apparatus 20 by any suitable fastening means such as a screw member 38 is a coin tray assembly 40 which includes a chute portion 42 extending through an aperture 44 located in the side wall 26, thereby providing an entry into the housing 22.

Figure 2:
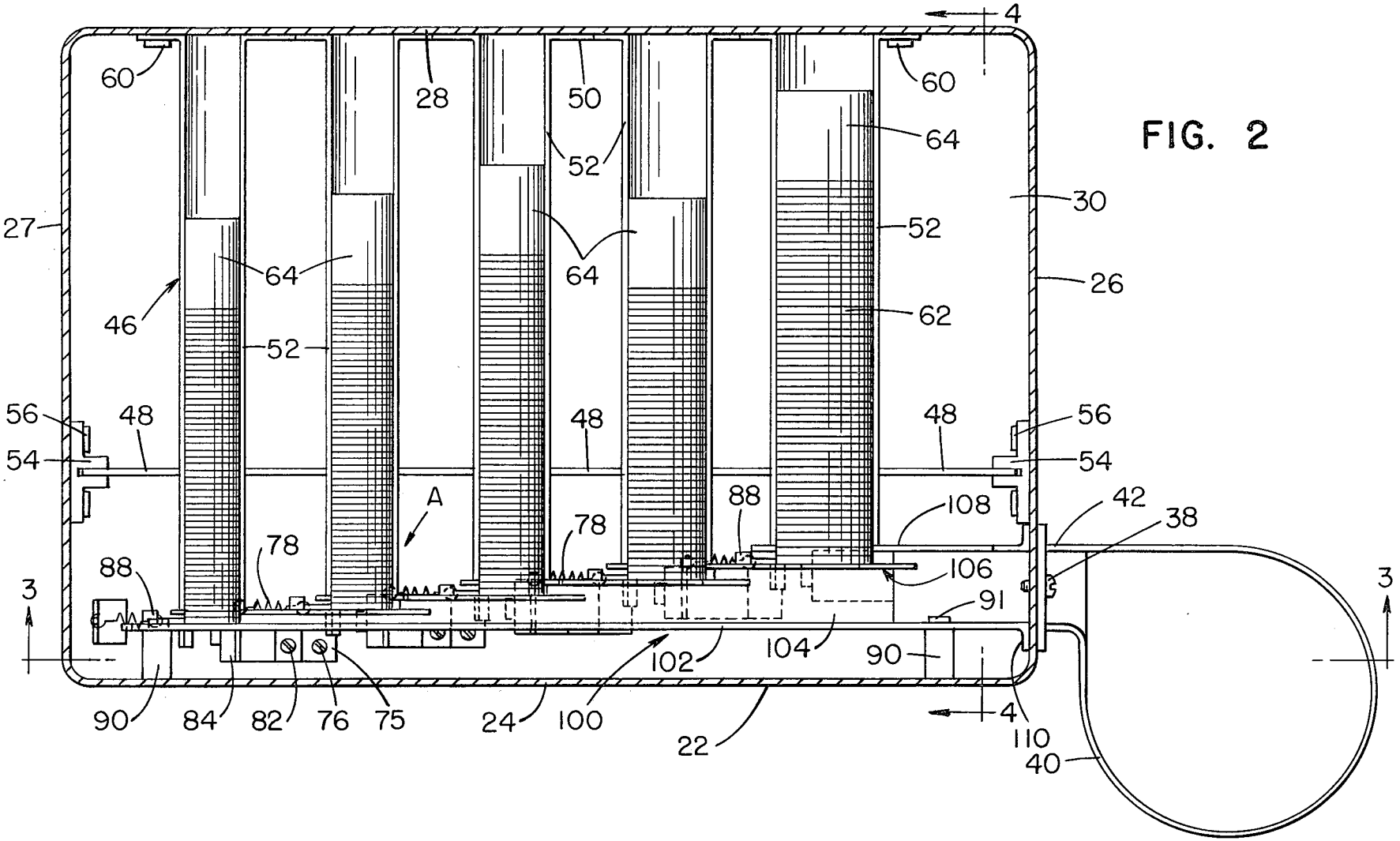
FIG. 2 is a top view of the change dispensing apparatus with the top cover removed so as to show the location of the coin channels and the coin delivery chuted within the dispensing apparatus housing.
Figure 3:
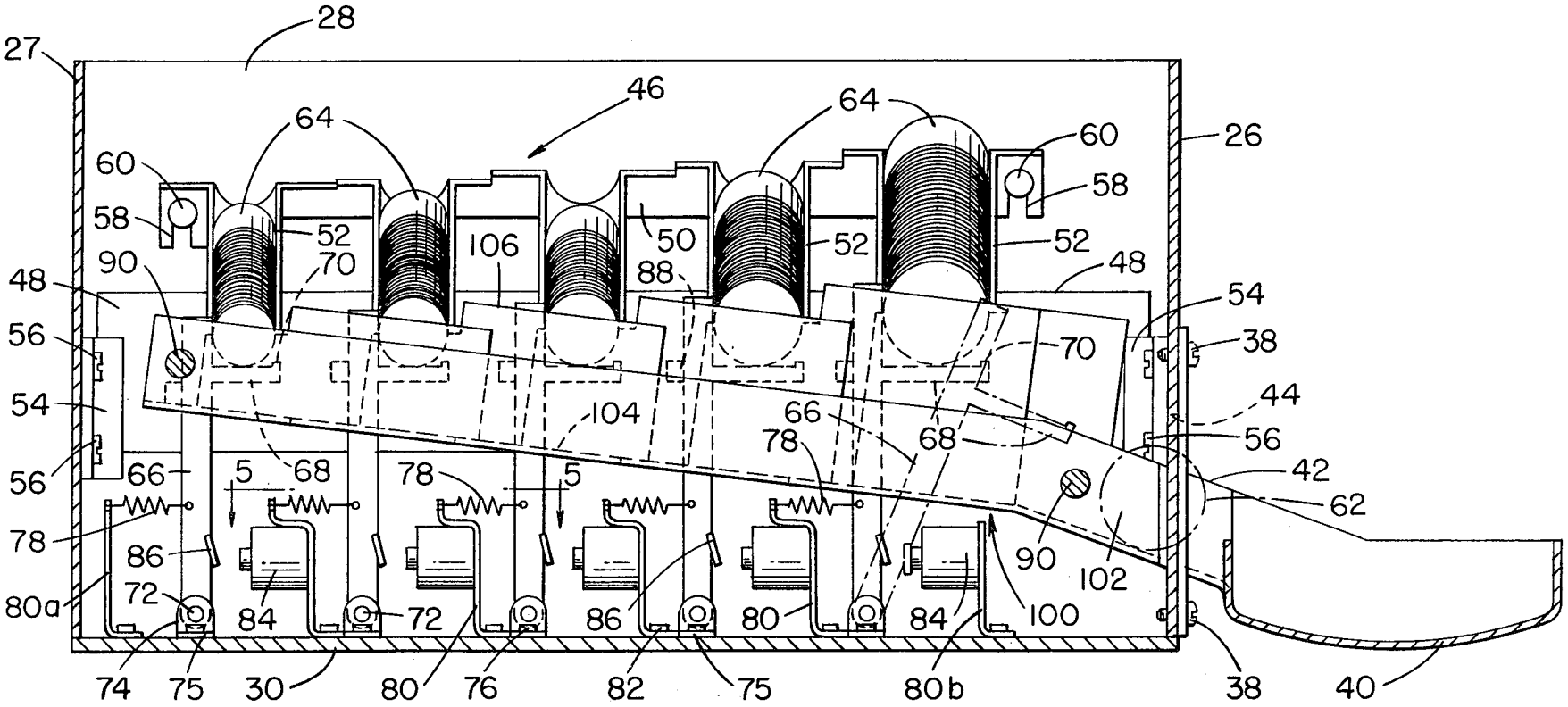
FIG. 3 is a sectional view taken on lines 3—3 of FIG. 2 showing a front view of the coin magazine and the coin actuator arm members shown in the home and actuated position.
Figure 4:
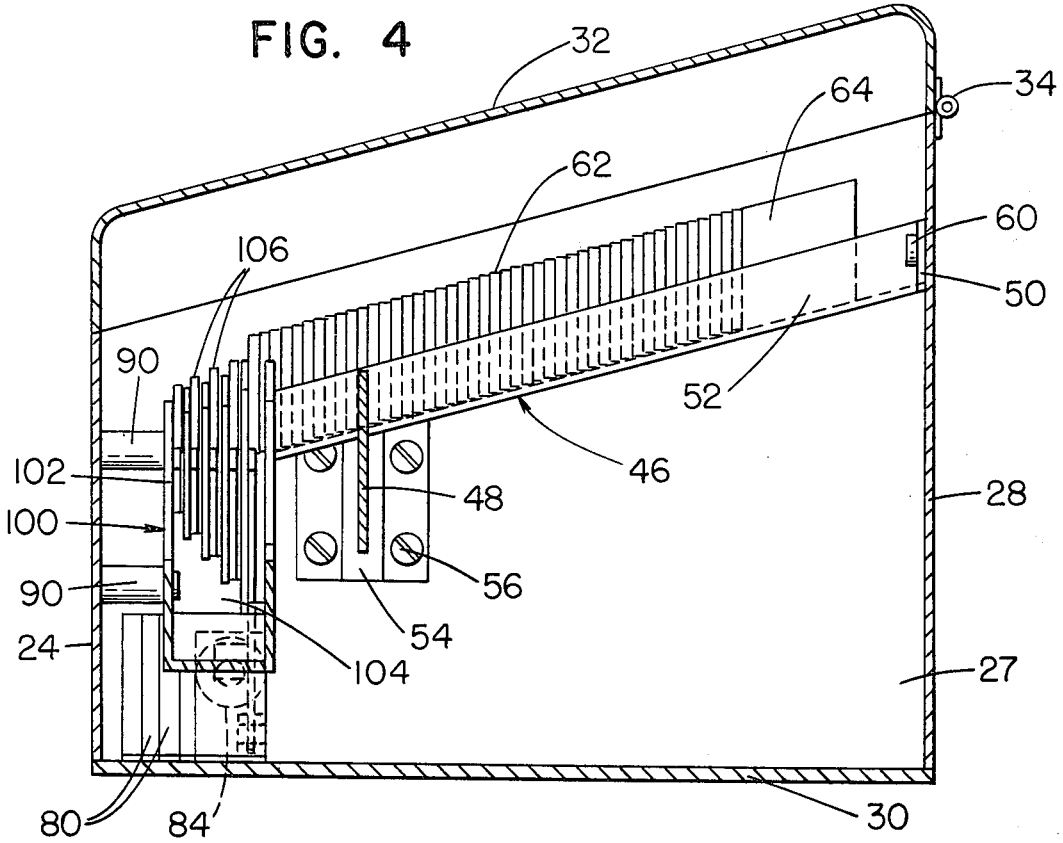
FIG. 4 is a sectional view of FIG. 1 taken on lines 4—4 of FIG. 2 showing a side view of the dispensing apparatus together with the mounting angle of the coin magazine.

As best seen in FIGS. 2, 3 and 4, within the housing 22 is a coin magazine generally indicated as 46 and which includes a front wall portion 48 and a rear support wall portion 50 between which are located a plurality of side-by-side, spaced-apart open channel members 52. The channel members 52 and the front 48 and rear 50 wall portions making up such coin magazine 46 may be formed as one unit or assembled separately in any well known manner. If the magazine is to be constructed of plastic, injection molding would be one method of fabricating the magazine.

As shown more clearly in FIG. 2, all of the channel members 52 are interconnected by the front wall portion 48. The magazine 46 is preferably mounted in the housing by slidably positioning opposite ends of the front wall portion 48 thereof into a pair of U-shaped support bracket members 54, one secured to each of the side walls 26 and 27 by screws 56 or any other suitable fastening means. Opposite ends of the rear support wall 50 of the magazine contain a slot 58 (FIG. 3) which cooperate with studs 60 mounted on the rear wall 28 of the housing 22 to support the magazine 46 within the housing. It is obvious from this construction that the magazine 46 can be easiy inserted and supported within the housing 22 by positioning the rear support wall 50 of the magazine on the studs 60 and the front support wall 48 thereof within the support brackets 54.

In the embodiment shown in FIGS. 2 and 3, the coin magazine 46 contains five coin channels 52, each being of a different width to accommodate a different coin denomination. It is obvious that any number of coin channels can be so accommodated in this type of construction depending on the need of the business application. One advantage of this type of magazine construction is that a plurality of coin magazines 46 each containing a different number of coin channels 52 and denomination arrangement can be easily interchanged with the housing depending on the business application requirements.

As shown in FIG. 4, the coin channels 52 of the magazine 46 when mounted in the housing 22 are inclined at an acute angle with the base portion 30 or other horizontal plane. This mounting angle is chosen to allow a supply of coins 62 to be stacked on their edges in each channel 52 and to move freely down the channel under the control of gravity while providing the minimum amount of force on the lowermost coin of the supply. A weighted member 64 is provided in each channel and is so shaped as to keep the coins stacked on their edges in the channel and appropriately weighted so as to provide sufficient moving force on the lowermost coin as the coins are depleted through the dispensing operation. In this regard, and as one example, with channels 52 of the present embodiment being mounted at approximately a 15 degree angle with the horizontal plane, as shown in FIG. 4, such a member 64 equalling ten coins in weight will in each instance provide sufficient minimum weight on the lowermost coin to insure downward movement thereof along its respective channel.

Figure 6:
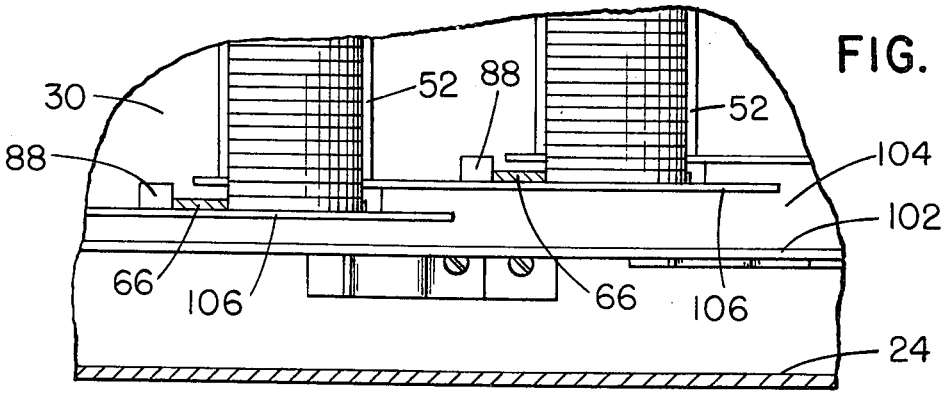
FIG. 6 is an enlarged top view of the actuator arm member and the guide plates taken in zone A of FIG. 2.

Adjacent the lower edge of each of the coin channels 52 is a coin actuator arm member 66. As shown in FIGS. 3 and 6, the arm member 66 is positioned between the lower open end of its associated channel 52 and a guide plate 106 the function of which will be described more fully hereinafter. The top portion of the arm member 66 extends upwardly beside the lowermost coin to a height which is above the center of such lowermost coin in the channel 52 to allow the arm member to move the coin. The arm member 66 includes a support portion 68 which extends in a horizontal direction across the lower edge of the opening of the channel 52 and terminates with an abutment portion 70. The length of the support portion 68 of each arm member 66 is generally dependent upon the width of the associated coins to be dispensed although it is obvious that one length can accommodate several different coin denominations. The support portion 68 is normally positioned adjacent the opening of its associated channel 52 so that the lowermost coin in the channel will be moved by the weight of the stack of coins 62 and/or weight member 64 in the channel into a supported position on the actuator arm member 66 support portion 68. The abutment portion 70 of the support portion 68 prevents the coin from rolling off the support portion when the actuator arm member 66 is in the home position as shown in FIG. 3.

Figure 5:
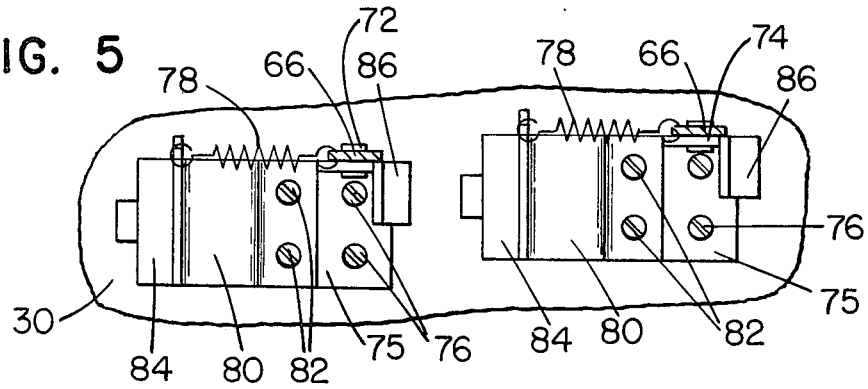
FIG. 5 is an enlarged top view taken on lines 5—5 of FIG. 3 showing the mounting of the return spring to the actuator arm member.

As clearly shown in FIGS. 3 and 5, each of the arm member 66 is rotatably mounted on a support pin 72 secured to an upturn arm portion 74 of a support member 75 which in turn is secured to the base portion 30 of the housing 22 by any suitable fastening means such as screws 76 or the like. Engaging each of the arm members 66 is a spring 78 secured between a support member 80 and the arm member 66. The support member 80 is secured to the base portion 30 of the housing 22 by any suitable fastening means such as screws 82. Mounted to the support member 80 in any suitable manner is a solelnoid 84 which coacts with a contact plate 86 secured to the adjacent arm member 66 located upstream from the solenoid 84. With such arrangement, the solenoid 84 will rotate the arm member in a clockwise direction when energized against the action of the spring 78. It is obvious from the construction shown in FIG. 3 that the length of the clockwise movement of the actuating arm 66 is determined by the position of the solenoid 84 with respect to the contact plate 86. As illustrated in FIG. 3, the solenoid and actuator arm member arrangement is such that the leftmost support member 80*a* provides only a spring 78 anchor while the rightmost such member 80*b* provides only a solenoid 84 mount. As best seen in FIG. 2, the support member 80, 80*a*, 80*b* and the solenoid 84 associated with the actuator arm member 66 are positioned in a staggered arrangement on the base portion 30 of the housing 22 to accommodate rocking movement of the actuator arm member 66 associated with adjacent coin channels 52. As will be explained more fully hereinafter, clockwise rocking of the arm 66 upon energization of the solenoid 84 will kick or otherwise move the coin 62 supported on the support portion 68 to a dispensing position where the coin will roll off the support portion into a coin chute.

Upon deenergizing of the solenoid 84, which normally occurs at the end of a coin dispensing operation, the spring 78 will return the arm member 66 counterclockwise until it engages a stop member 88 mounted in any suitable manner on the guide plate 106 (FIGS. 3 and 6). As mentioned earlier, a guide plate 106 is located adjacent each of the coin channel 52 and will be described more fully hereinafter. The stop member 88 positions the arm member 66 in the home, coin supporting position as shown in FIG. 3.

Mounted on a pair of spaced-apart studs 90 (FIGS. 2, 3 and 4) secured to the front wall 24 of the housing 22 by means of screws 91 is a coin chute assembly generally indicated as 100 and extending along the front edge of the coin magazine 46. The chute assembly 100 includes a front wall portion 102 and a floor portion 104 orientated at an angle with the housing base portion 30 such that a coin when deposited on the floor portion 104 on its edge will roll towards the coin receptacle 40 (FIG. 3). As best seen in FIG. 2, the inside edge of the floor portion 104 is in the form of a plurality of stepped portions or ridges so as to accommodate the plurality of actuator arm members 66 and permit rocking thereof to occur while providing a floor area for the coin to be deposited thereon in each instance by action of the arm member 66.

As set out previously, associated with each of the arm members 66 in the dispensing of a coin from the coin channels 52 is an upstanding guide plate 106 secured to the floor portion 104 of the coin chute 100 by any suitable manner such as welding, integral molding or the like. As understood from FIGS. 2, 3 and 6, each guide plate 106 extends in a vertical direction and is positioned adjacent the edge of its associated coin channel 52, with the guide plate extending downstream past the next adjacent coin channel in each instance. When positioned in this manner, the guide plate 106 is located adjacent the actuator arm 66 of the next coin channel 52 and coacts with the guide plate 106 of such next coin channel to form a chute arrangement through which the coin from the next coin channel will be guided as the actuator arm 66 is rocked in dispensing the coin from that next coin channel. In addition, the guide plate 106 forms a stopping surface for the lowermost coin of the next coin channel when the actuator arm 66 is in its home position. Because the guide plate 106 extends vertically, the coins 62 will be stacked on their edges in the coin channel 52 (see FIG. 4). Thus, as shown in FIG. 3, each guide plate 106 extends immediately beyond its associated actuator arm member 66 and reaches a height which will hold the stack of coins 62 in the associated coin channel 52.

The coin chute assembly 100 also includes a rear wall portion 108 which extends from the last coin channel 52 on the right as viewed in FIG. 1. This wall portion 108, together with the front wall portion 102, terminates in a flange portion 110 which is positioned adjacent the slot 44 on the side wall 26 of the housing 22 and in contact with the chute portion 42 of the coin receptacle 40. Thus, coins rolling down the coin chute assembly 100 by means of gravity will be deposited in the coin receptacle 40.

In operation of the dispensing mechanism, coins 62 will be loaded into each of the coin channels 52 by swinging the cover 32 back and inserting the coins in the proper coin channel, together with positioning the associated weight member 64 so that the coins remain in an upright position in the channel. Energizing of any of the solenoids 84 results in the clockwise rocking of its associated actuator arm member 66 due to the movement of the contact plate 86 toward the solenoid 84. This rocking of the actuator arm member 66 will move the support portion 68 of the arm from its horizontal normal (coin supporting ) position to an angular (coin dispensing) position, thereby causing the coin supported on such support portion to roll off the end thereof and into the coin chute assembly 100 where it will roll down into he coin receptacle 40. This condition is shown in FIG. 3 when the rightmost arm member 66 is shown in dotted outline in an actuated position. As the actuating arm member 66 is rocked in a clockwise direction, the upper portion of such arm member 66 will move to a position to block the downward movement of the next coin 62 in the coin channel 52. As mentioned earlier, upon deenergizing of the solenoid 84, the spring 78 engaging actuating arm 66 will rock the arm counterclockwise until it engages the stop member 88. At this time, the next coin in the channel 52 will move onto the support portion 68 of the arm member 66 and against the guide plate 106 where it is positioned to be dispensed upon the next energization of the solenoid 84.

It will thus be seen that the present embodiment provides a change dispensing structure which requires a minimum amount of force to dispense the coins from the coin channels. This feature allows a single actuating member to dispense a coin from the coin channel utilizing a relatively low power drive member, all within the objects and advantages of the instant invention above stated.

While the principals of the invention have now been made clear in an illustrated embodiment, it will be obvious to those skilled in the art that many modifications of structure, arrangements, elements and components can be made which are particularly adapted for specific environments and operating requirements without departing from those principals. The appended claims are therefore intended to cover and embrace any such modifications, within the limits only of the true spirit and scope of the invention.

What is claimed is:

1. A change dispensing apparatus including in combination:

a. a coin channel orientated at an acute angle with a base plane and adapted to receive coins to be dispensed, said coin channel having a discharge end;

b. a coin chute adjacent the discharge end of the coin channel to support vertically orientated coins dispensed from the coin channel, said coin chute extending in a generally downward direction whereby coins will move along the chute on their edges by gravity;

c. a coin receptacle adjacent the end of the coin chute to receive coins deposited on the chute;

d. an actuator member adapted for movement to a dispensing position and located adjacent the discharge end of the coin channel, said actuator member having a coin supporting portion extending in a generally horizontal direction to support a coin on its edge when the actuator member is a non-dispensing position;

e. a vertically extending member mounted on said coin chute engaging and positioning the lowermost coin in the coin channel on said coin supporting portion of said actuator member;

f. and means operatively associated with said actuator member to selectively move the actuator member from a non-dispensing position to a dispensing position wherein said supporting portion moves to an inclined position to deposit the lowermost coin on the coin chute for movement to the coin receptacle.

2. The change dispensing apparatus of claim 1 in which the supporting portion of the actuator member includes a stop portion for maintaining a coin on the supporting portion when the actuator member is in its non-dispensing position.

3. The change dispensing apparatus of claim 1 in which the actuator member includes an upper portion extending above said supporting portion adjacent a coin when supported on the supporting portion, said upper portion engaging and moving a supported coin from the coin channel upon movement of the actuator member to its dispensing position whereby such coin will be discharged from the supporting portion onto the coin chute for delivery to the coin receptacle.

4. The change dispensing apparatus of claim 1 in which said guide means comprises a vertically extending member extending past the discharge end of the coin channel to guide a coin in a dispensing direction upon movement of the actuator member to its dispensing position.

5. The change dispensing apparatus of claim 3 which further includes means engaging an uppermost coin in the coin channel for constantly urging said coin and any coins therebelow toward the discharge end of the coin channel.

6. The change dispensing apparatus of claim 4 which further includes stop means on said vertically extending member, said stop means positioned in the plane of movement of said actuator member to position the actuator member at is nondispensing position and means for normally urging said actuator member into engagement with said stop member.

7. The change dispensing apparatus of claim 5 in which said constantly urging means is positioned within the coin channel and has a coin contacting surface orientated for maintaining coins in such channel in a substantially vertical direction.

8. A change dispensing apparatus including in combination:

a. a plurality of coin channels each having a discharge end and adapted to receive coins of a particular denomination to be dispensed;

b. means for supporting the coin channels at an acute angle with a horizontal plane whereby coins in each of said coin channels will move towards the discharge end by gravity;

c. an arm member rotatably mounted adjacent the discharge end of each coin channel, said arm member including a supporting portion extending laterally adjacent the lower edge of the coin channel to support a coin on its edge when the arm member is in a non-actuated position;

d. means supporting said arm member for movement between an actuated and non-actuated position;

e. a coin delivery chute adjacent the discharge end of the coin channel and the arm member;

f. a plate member secured to said coin delivery chute adjacent the discharge end of the coin channel, said plate member engaging and maintaining the lowermost coin in the coin channel on edge on said support member;

g. and means for actuating said arm member when operated whereby the arm member is moved from a non-actuated position to an actuated position whereupon the coin supported thereby is dispensed into the coin delivery chute.

9. The change dispensing apparatus of claim 8 in which the supporting portion of the arm member includes an abutment for maintaining a coin on the supporting portion when the arm member is in the non-actuated position.

10. The change dispensing apparatus of claim 8 in which the arm member is approximately vertically disposed and includes an upper portion extending to a position adjacent a coin when supported on the supporting portion while the arm member is in the non-actuated position, said upper portion engaging and moving such supported coin from the coin channel upon movement of the arm member to the actuated position whereby the supported coin is dispensed into the coin delivery chute.

11. The change dispensing apparatus of claim 10 in which the upper portion of the arm member is positioned to engage and block coins from moving out of the coin channel while the arm member is in the actuated position.

12. The change dispensing apparatus of claim 8 in which the supporting portion of the arm member is normally positioned approximately horizontal and becomes inclined therefrom when the arm member is moved to its actuated position whereby a supported coin thereon will be discharged thereby into the coin delivery chute.

13. The change dispensing apparatus of claim 12 in which the plate member associated with the coin channels each extends downstream of the coin channel in an overlapping relationship with an adjacent plate member to guide coins discharged by movement of said arm member to said coin delivery chute.

14. The change dispensing apparatus of claim 13 which further includes:

a. stop means on said plate member, said stop means postioned in the path of movement of said arm members for positioning the arm member in a non-actuated position;

b. and means normally urging said arm member into engagement with said stop means whereby the arm member is moved to the non-actuated position upon release of the arm member by said actuating means.

15. The change dispensing apparatus of claim 14 which further includes means positioned in each of the coin channels for normally moving the coins therein toward the discharge end thereof.

16. The change dispensing apparatus of claim 15 in which said moving means comprises a weighted member having a coin engaging surface which is orientated in a generally vertical direction whereby the coins in the coin channel are caused to be stacked on edge in the channel.

17. A change dispensing apparatus including:

a. a housing member;

b. a coin magazine within said housing member, said coin magazine including a plurality of open coin channels for supporting a stack of coins therein, each of said coin channels having a discharge end;

c. means for supporting the coin magazine at an acute angle with the horizontal whereby coins in said coin channels will gravitationally move toward the discharge ends thereof;

d. a coin delivery chute positioned adjacent the discharge end of each of the coin channels and extending in a generally downward direction;

e. a guide member associated with the discharge end of each of the coin channels, said guide member engaging the lowermost one of the coins in the coin channel to orientate said coin approximately vertically on its edge;

f. a support member between the guide member and the discharge end of each of the coin channels, said support member extending in a generally horizontal direction for supporting the lowermost coin on its edge in the coin channel when in a non-dispensing position;

g. means supporting said support member for movement between a dispensing and non-dispensing position;

h. first actuating means engaging said support member for normally urging the support member to the non-dispensing position;

i. and second actuating means engaging said support member for moving the support member against the action of said first actuating means to the dispensing position when operated to position the support member in a non-horizontal position whereby the coin supported on said support member is discharged therefrom to said coin delivery chute.

18. A change dispensing apparatus including:

a. a housing member;

a coin magazine within said housing member, said coin magazine including a plurality of open coin channels for supporting a stack of coins therein, each of said coin channels having a discharge end;

c. means for supporting the coin magazine at an acute angle with the horizontal whereby coins in said coin channels will gravitationally move toward the discharge ends thereof;

d. a coin delivery chute positioned adjacent the discharge end of each of the coin channels and extending in a generally downward direction;

e. a guide member associated with the discharge end of each of the coin channels, said guide member engaging the lowermost one of the coins in the coin channel to orientate said coin approximately vertically on its edge;

f. a support member between the guide member and the discharge end of each of the coin channels, said support member extending, when in a non-dispensing position, in a generally horizontal direction for supporting the lowermost coin on its edge in the coin channel;

g. means supporting said support member for movement between a dispensing and non-dispensing position;

h. and means operatively associated with said support member to selectively move the support member from a non-dispensing position to a dispensing position wherein said support member is moved to a non-horizontal position whereby the supported coin will be discharged from the support member to the coin delivery chute.

* * * * *